United States Patent [19]

Polanco et al.

[11] Patent Number: 4,824,439

[45] Date of Patent: Apr. 25, 1989

[54] INFLAME DESULFURIZATION AND DENOXIFICATION OF HIGH SULFUR CONTAINING FUELS

[75] Inventors: Domingo R. Polanco, Calle Los Gabrieles; Jose S. Perez, San Antonio de Los Altos; Euler J. Grazzina, Caracas; Niomar Marcano, Los Teques, all of Venezuela

[73] Assignee: Intevep, S.A., Caracas, Venezuela

[21] Appl. No.: 133,323

[22] Filed: Dec. 16, 1987

Related U.S. Application Data

[63] Continuation-in-part of Ser. No. 14,871, Feb. 17, 1987, which is a continuation-in-part of Ser. No. 875,450, Jun. 17, 1986.

[51] Int. Cl.[4] ..... C10L 1/32

[52] U.S. Cl. ..... 44/51; 431/3; 431/4; 252/312

[58] Field of Search ..... 431/3, 4; 44/51; 252/312

[56] References Cited

U.S. PATENT DOCUMENTS 2,845,358 7/1958 Ryznar et al. ..... 44/5
3,332,755 7/1967 Kukin ..... 44/4
3,837,820 9/1974 Kukin ..... 44/51
4,488,866 12/1984 Schirmer et al. ..... 431/4
4,512,774 4/1985 Myers et al. ..... 44/51

OTHER PUBLICATIONS

Sekiyu et al., Abstrwact 56-159291(A), Removal of Sulfur Oxide and Nitrogen Oxide, 8-12-1981, Japanese.

*Primary Examiner*—William R. Dixon, Jr.
*Assistant Examiner*—Margaret B. Medley
*Attorney, Agent, or Firm*—Bachman & LaPointe

[57] ABSTRACT

A process for the preparation of a liquid fuel and resulting fuel including a sulfur and nitrogen capturing additive consisting essentially of $Na^+$, $Fe^{++}$ and an element X selected from group consisting of $Mg^{++}$, $Ba^{++}$, $Ca^{++}$, $Li^+$, $K^+$ and mixtures thereof wherein $Na^+$ is present in an amount of less or equal to 40 wt. % based on the total weight of the water soluble additive $Fe^{++}$ is present in an amount of greater than or equal to 0.4 wt. % based on the total weight of the water soluble additive with the balance essentially element X wherein the ratio of $Na^+$ and $Fe^{++}$ is about between 7.5:1.0 to 100:1.0.

7 Claims, 1 Drawing Sheet

EFFECT OF ADDITIVES ON $SO_2$ EMISSIONS

INFLAME DESULFURIZATION AND DENOXIFICATION OF HIGH SULFUR CONTAINING FUELS

CROSS REFERENCE TO RELATED APPLICATIONS

This application is related to Application Ser. No. 133,327, filed concurrently herewith and is a Continuation-In-Part of Application Ser. No. 014,871, filed Feb. 17, 1987 which in turn is a Continuation-In-Part of Application Ser. No. 875,450, filed June 17, 1986.

BACKGROUND OF THE INVENTION

The present invention relates to a process for the preparation of liquid fuels and the resulting fuel and, more particularly, a process that allows a high sulfur and nitrogen containing fuel to be converted into energy by combustion with a substantial reduction in sulfur oxide emissions and nitrogen oxide emissions.

Low gravity, viscous hydrocarbons found in Canada, The Soviet Union, United States, China and Venezuela are normally liquid with viscosities ranging from 10,000 to 200,000 CP and API gravities of less than 12. These hydrocarbons are currently produced either by mechanical pumping, steam injection or by mining techniques. Wide-spread use of these materials as fuels is precluded for a number of reasons which include difficulty in production, transportation and handling of the material and, more importantly, unfavorable combustion characteristics including high sulfur oxide emissions and unburned solids. To date, there are two commercial processes practiced by power plants to reduce sulfur oxide emissions. The first process is furnace limestone injection wherein limestone injected into the furnace reacts with the sulfur oxides to form solid sulfate particles which are removed from the flue gas by conventional particulate control devices. The cost for burning a typical high sulfur fuel by the limestone injection method is between two to three dollars per barrel and the amount of sulfur oxides removed by the methods is in the neighborhood of 50%. A more effective process for removing sulfur oxides from power plants comprises flue gas desulfurization wherein $CaO+H_2O$ are mixed with the flue gases from the furnace. In this process 90% of the sulfur oxides are removed; however the cost for burning a barrel of fuel using the process is between four and five Dollars per barrel. Because of the foregoing, the high sulfur content, viscous hydrocarbons have not been successfully used on a commercial basis as fuels due to the high costs associated with their burning.

It is well known in the prior art to form oil in water emulsions for use as a combustible fuel. See for example U.S. Pat. Nos. 4,114,015; 4,378,230 and 4,618,348. In addition to the foregoing, the prior art teaches that oil in water emulsions formed from low gravity, viscous hydrocarbons can likewise be successfully combusted as a fuel. See for example British Patent Specification No. 974,042 and U.S. Pat. No. 4,618,348. The assignee of the instant application has discovered that sulfur-oxide emissions can be controlled when burning viscous high sulfur containing hydrocarbon in water emulsions by the addition of sulfur capturing additives to the emulsion composition. See U.S. Application Ser. Nos. 875,450 and 014,871.

Naturally, it would be highly desirable to develop a process for the preparation of liquid fuels and a resultant liquid fuel which, upon combustion, has a substantial reduction in sulfur oxide and nitrogen oxide emissions.

Accordingly, it is the principal object of the present invention to provide an additive for addition to a hydrocarbon fuel which, upon combustion of the fuel, acts as a sulfur and nitrogen capturing agent so as to substantially reduce the formation and emission of sulfur and nitrogen oxides.

It is a particular object of the present invention to provide a process as set forth above which is useful for hydrocarbon in water emulsions to be burned as fuels.

Further objects and advantages of the present invention will appear hereinbelow.

SUMMARY OF THE INVENTION

The present invention relates to a process for the preparation of liquid fuels and the resulting fuel and, more particularly, a process that allows a high sulfur and nitrogen containing fuel to be converted into energy by combustion with a substantial reduction in sulfur oxide emissions and nitrogen oxide emissions.

It is well known in the art to form oil in water emulsions either from naturally occurring bitumens or residual oil in order to facilitate the production and/or transportation of these viscous hydrocarbons. Typical processes are disclosed in U.S. Pat. Nos. 3,380,531; 3,467,195; 3,519,006; 3,943,954; 4,099,537; 4,108,193; 4,239,052 and 4,570,656. In addition to the foregoing, the prior art teaches that oil in water emulsions formed from naturally occurring bitumens and/or residual oils can be used as combustible fuels. See for example U.S. Pat. Nos. 4,144,015; 4,378,230 and 4,618,348.

The present invention is drawn to a process for the preparation of a liquid fuel and the resulting fuel which, upon combustion, exhibits a substantial reduction in sulfur oxide emissions and nitrogen oxide emissions. As noted above, the particular process is useful for fuels in the form of hydrocarbon in water emulsions as disclosed in co-pending Application Ser. Nos. 014,871 and 875,450.

The process of the present invention comprises admixing a sulfur and nitrogen containing hydrocarbon (either hydrocarbon residual, hydrocarbon in water emulsion, or other suitable hydrocarbon) with a water soluble additive which acts as a capturing agent for sulfur and nitrogen upon combustion of the hydrocarbon as a fuel. In accordance with the present invention, the water soluble additive consists essentially of $Na^+$, $Fe^{++}$ and an element X selected from group consisting of $Mg^{++}$, $Ba^{++}$, $Ca^{++}$, $Li^+$, $K^+$ and mixtures thereof wherein $Na^+$ is present in an amount of less than or equal to 40 wt.% based on the total weight of the water soluble additive, $Fe^{++}$ is present in an amount of greater than or equal to 0.4 wt.% based on the total weight of the water soluble additive with the balance essentially element X wherein the ratio of $Na^+$ and $Fe^{++}$ is about between 7.5:1.0 to 100:1.0.

It has been found that the $Fe^{++}$ addition acts as a nitrogen capturing agent thereby reducing the amount of nitrogen oxide emissions. The $Na^+$ addition acts as a strong sulfur capturing agent for reducing sulfur oxide emissions; however, as the $Na^+$ addition tends to be corrosive to boiler apparatuss the amount of $Na^+$ in the additive should be limited. The remaining element X acts as a sulfur capturing agent and is used as a positive addition to complement the amount of $Na^+$ in the additive formulation. The overall additive formulation results in an effective sulfur and nitrogen capturing additive which does not result in serious detrimental corrosion of boiler apparatus.

DETAILED DESCRIPTION

Figure 2:
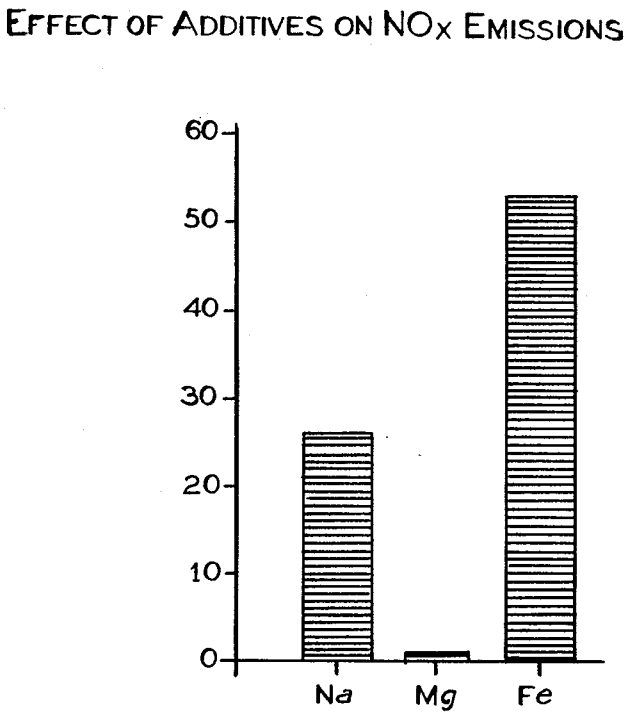
FIG. 2 is a bar graph showing the effect of additives on the reduction of nitrogen oxide emissions.

In accordance with the present invention, the process of the present invention is drawn to the preparation and burning of a fuel formed from a naturally occurring bitumen or residual fuel oil product. One of the fuels for which the process is suitable is a bitumen crude oil having a high sulfur content such as those crudes typically found in the Orinoco Belt of Venezuela. The bitumen or residual oil has the following chemical and physical properties: C wt.% of 78.2 to 85.5, H wt.% of 9.0 to 10.8, O wt.% of 0.2 to 1.3, N wt.% of 0.50 to 0.70, S wt.% of 2 to 4.5, Ash wt.% of 0.05 to 0.33, Vanadium, ppm of 50 to 1000, Nickel, ppm of 20 to 500, Iron, ppm of 5 to 60, Sodium, ppm of 30 to 200, Gravity, °API of 1.0 to 12.0, Viscosity (CST), 122° F. of 1,000 to 5,100,000, Viscosity (CST), 210° F. of 40 to 16,000, LHV (BTU/lb) of 15,000 to 19,000, and Asphaltenes wt.% of 9.0 to 15.0. In accordance with one feature of the present invention, a mixture comprising water and an emulsifying additive is mixed with a viscous hydrocarbon or residual fuel oil so as to from an oil in water emulsion. The characteristics of the oil in water emulsion and the formation of same are set forth in the above-referenced co-pending applications which are incorporated herein by reference. In accordance with the present invention, an additive which captures sulfur and nitrogen and prohibits the formation and the emission of sulfur oxides and nitrogen oxides during combustion of the hydrocarbon or hydrocarbon in water emulsion fuel is added to the fuel prior to the combustion of same. The water soluble additive for use in the process of the present invention consists essentially of $Na^+$, $Fe^{++}$ and an element X selected from the group consisting of $M_g^{++}$, $Ba^{++}$, $Ca^{++}$, $Li^+$, $K^+$ and mixtures thereof. In accordance with the particular feature of the present invention the $Na^+$ is present in an amount of less than or equal to 40 wt.% based on the total weight of the water soluble additive. The $Fe^{++}$ is present in an amount of greater than or equal to 0.4 wt.% based on the total weight of the water soluble additive. The balance of the water soluble additive is made up by the element X. The ratio of $Na^+$ to $Fe^{++}$ in the additive ranges from about between 7.5:1.0 to 100:1.0. The preferred formulation for the additive of the present invention used in the process of the present invention consists essentially of $Na^+$ in an amount of between 5 to 40 wt.% based on the total weight of the water soluble additive, $Fe^{++}$ in an amount of 0.4 to 2.0 wt.% based on the total weight of the water soluble additive with the balance essentially element X. It has been found that in order to obtain the desired emissions levels with respect to sulfur and nitrogen upon combustion of the fuel produced by the process of the present invention, the additive must be present in a molar ratio of additive to sulfur in the fuel of greater than or equal to 0.500 and preferably greater than 0.750.

The advantages of the present invention will be clear from consideration of the following example.

EXAMPLE

In order to demonstate the effect of the additive of the present invention on the combustion characteristics of hydrocarbon fuels containing sulfur and nitrogen, ten additive formulations were prepared. The composition of the additive formulations are set forth hereinbelow in Table I.

TABLE I

| Additive No. | Composition (wt. %) Mg | Na | Fe |
|---|---|---|---|
| 1 | 80.5 | 18.9 | 0.65 |
| 2 | 62.2 | 37.3 | 0.50 |
| 3 | 67.4 | 32.1 | 0.40 |
| 4 | 67.4 | 32.1 | 0.43 |
| 5 | 79.5 | 19.2 | 1.28 |
| 6 | 61.9 | 37.1 | 0.99 |
| 7 | 83.0 | 15.9 | 1.06 |
| 8 | 67.2 | 32.0 | 0.86 |
| 9 | 2.7 | 97.3 | 0.00 |
| 10 | 98.8 | 0.00 | 1.2 |

Each of the additives were added to various oil in water emulsions for burning as natural fuels. The fuel characteristics operating conditions and combustion characteristics for the fuels admixed with each additive are set forth below in Tables II–XI.

TABLE II

| | ADDITIVE NO. 1 | | | | | |
|---|---|---|---|---|---|---|
| | BASELINE EMULSION | EMULSION #1 | EMULSION #2 | EMULSION #3 | EMULSION #4 | EMULSION #5 |
| | FUEL CHARACTERISTICS | | | | | |
| Additive 1/S (Molar Ratio) | 0 | 0.25 | 0.38 | 0.50 | 0.75 | 0.91 |
| LHV (BTU/lb) | 12995 | 12029 | 11608 | 11203 | 10484 | 9852 |
| Bitumen, wt. % | 74 | 68.5 | 66.1 | 63.8 | 59.7 | 56.1 |
| Water, wt. % | 26 | 31.5 | 33.9 | 36.2 | 40.3 | 43.9 |
| Sulfur, wt. % | 2.8 | 2.6 | 2.5 | 2.4 | 2.3 | 2.1 |
| | OPERATING CONDITIONS | | | | | |
| Feed Rate (lb/h) | 55.1 | 59.5 | 61.7 | 63.9 | 68.3 | 72.7 |
| Thermal Input (MMBTU/h) | 0.75 | 0.75 | 0.75 | 0.75 | 0.75 | 0.75 |
| Fuel Temperature (°F.) | 149 | 150 | 149 | 151 | 149 | 150 |
| Steam/Fuel Ratio (w/w) | 0.30 | 0.30 | 0.30 | 0.30 | 0.30 | 0.30 |
| Steam Pressure (bar) | 2.4 | 2.4 | 2.4 | 2.4 | 2.4 | 2.4 |
| | COMBUSTION CHARACTERISTICS | | | | | |
| CO (ppm) | 10 | 16 | 10 | 4 | 15 | 11 |

TABLE II-continued

| | ADDITIVE NO. 1 | | | | | |
|---|---|---|---|---|---|---|
| | BASELINE EMULSION | EMULSION #1 | EMULSION #2 | EMULSION #3 | EMULSION #4 | EMULSION #5 |
| $CO_2$ (Vol %) | 14.3 | 14.5 | 14.5 | 15.0 | 15.0 | 14.0 |
| $O_2$ (Vol %) | 3.0 | 3.0 | 2.9 | 2.8 | 2.9 | 2.9 |
| $SO_2$ (ppm) | 2100 | 1175 | 1000 | 700 | 350 | 200 |
| $SO_2$ Reduction (%) | 0 | 44.1 | 52.4 | 66.7 | 83.3 | 90.5 |
| $NO_x$ (ppm) | 550 | 435 | 300 | 240 | 140 | 150 |
| $NO_x$ reduction (%) | 0 | 20.9 | 45.5 | 56.4 | 74.6 | 72.7 |
| Combustion Efficiency (%) | 99.8 | 99.9 | 99.9 | 99.9 | 99.9 | 99.9 |

TABLE III

| | ADDITIVE NO. 2 | | | | |
|---|---|---|---|---|---|
| | BASELINE EMULSION | EMULSION #1 | EMULSION #2 | EMULSION #3 | EMULSION #4 |
| | FUEL CHARACTERISTICS | | | | |
| Additive 2/S (Molar Ratio) | 0 | 0.33 | 0.49 | 0.65 | 0.70 |
| LHV (BTU/lb) | 12995 | 12029 | 11608 | 11203 | 10484 |
| Bitumen, wt. % | 74 | 68.5 | 66.1 | 63.8 | 59.7 |
| Water, wt. % | 26 | 31.5 | 33.9 | 36.2 | 40.3 |
| Sulfur, wt. % | 2.8 | 2.6 | 2.5 | 2.4 | 2.3 |
| | OPERATING CONDITIONS | | | | |
| Feed Rate (lb/h) | 55.1 | 59.5 | 61.7 | 63.9 | 68.3 |
| Thermal Input (MMBTU/h) | 0.75 | 0.75 | 0.75 | 0.75 | 0.75 |
| Fuel Temperature (°F.) | 149 | 150 | 149 | 151 | 149 |
| Steam Fuel Ratio (w/w) | 0.30 | 0.30 | 0.30 | 0.30 | 0.30 |
| Steam Pressure (bar) | 2.4 | 2.4 | 2.4 | 2.4 | 2.4 |
| | COMBUSTION CHARACTERISTICS | | | | |
| CO (ppm) | 10 | 5 | 5 | 14 | 7 |
| $CO_2$ (Vol %) | 14.3 | 14.0 | 14.0 | 14.0 | 14.0 |
| $O_2$ (Vol %) | 3.0 | 3.0 | 2.9 | 3.0 | 3.2 |
| $SO_2$ (ppm) | 2100 | 1150 | 750 | 380 | 280 |
| $SO_2$ Reduction (%) | 0 | 45.2 | 64.3 | 81.2 | 86.7 |
| $NO_x$ (ppm) | 550 | 260 | 210 | 180 | 120 |
| $NO_x$ reduction (%) | 0 | 52.7 | 62.0 | 67.3 | 78.2 |
| Combustion Efficiency (%) | 99.8 | 99.9 | 99.9 | 99.9 | 99.9 |

(*) Analyzer out of service

TABLE IV

| | ADDITIVE NO. 3 | | | | |
|---|---|---|---|---|---|
| | BASELINE EMULSION | EMULSION #1 | EMULSION #2 | EMULSION #3 | EMULSION #4 |
| | FUEL CHARACTERISTICS | | | | |
| Additive 3/S (Molar Ratio) | 0 | 0.30 | 0.45 | 0.60 | 0.90 |
| LHV (BTU/lb) | 12995 | 12029 | 11608 | 11203 | 10484 |
| Bitumen, wt. % | 74 | 68.5 | 66.1 | 63.8 | 59.7 |
| Water, wt. % | 26 | 31.5 | 33.9 | 36.2 | 40.3 |
| Sulfur, wt. % | 2.8 | 2.6 | 2.5 | 2.4 | 2.3 |
| | OPERATING CONDITIONS | | | | |
| Feed Rate (lb/h) | 55.1 | 59.5 | 61.7 | 63.9 | 68.3 |
| Thermal Input (MMBTU/h) | 0.75 | 0.75 | 0.75 | 0.75 | 0.75 |
| Fuel Temperature (°F.) | 149 | 150 | 149 | 151 | 149 |
| Steam Fuel Ratio (w/w) | 0.30 | 0.30 | 0.30 | 0.30 | 0.30 |
| Steam Pressure (bar) | 2.4 | 2.4 | 2.4 | 2.4 | 2.4 |
| | COMBUSTION CHARACTERISTICS | | | | |
| CO (ppm) | 10 | 16 | 26 | 6 | 5 |
| $CO_2$ (Vol %) | 14.3 | 14.0 | 14.5 | 14.0 | 14.0 |
| $O_2$ (Vol %) | 3.0 | 3.1 | 2.7 | 3.0 | 2.9 |
| $SO_2$ (ppm) | 2100 | 1250 | 900 | 600 | 250 |
| $SO_2$ Reduction (%) | 0 | 40.5 | 57.0 | 71.4 | 88.1 |
| $NO_x$ (ppm) | 550 | 310 | 210 | 115 | (*) |
| $NO_x$ reduction (%) | 0 | 44.0 | 62.0 | 79.1 | (*) |
| Combustion | 99.8 | 99.9 | 99.9 | 99.9 | 99.9 |

TABLE IV-continued

| | ADDITIVE NO. 3 | | | | |
|---|---|---|---|---|---|
| | BASELINE EMULSION | EMULSION #1 | EMULSION #2 | EMULSION #3 | EMULSION #4 |
| Efficiency (%) | | | | | |

(*) Analyzer out of service.

TABLE V

| | ADDITIVE NO. 4 | | | |
|---|---|---|---|---|
| | BASELINE EMULSION | EMULSION #1 | EMULSION #2 | EMULSION #3 |
| FUEL CHARACTERISTICS | | | | |
| Additive 4/S (Molar Ratio) | 0 | 0.38 | 0.56 | 0.75 |
| LHV (BTU/lb) | 12995 | 12029 | 11608 | 11203 |
| Bitumen, wt. % | 74 | 68.5 | 66.1 | 63.8 |
| Water, wt. % | 26 | 31.5 | 33.9 | 36.2 |
| Sulfur, wt. % | 2.8 | 2.6 | 2.5 | 2.4 |
| OPERATING CONDITIONS | | | | |
| Feed Rate (lb/h) | 55.1 | 59.5 | 61.7 | 63.9 |
| Thermal Input (MMBTU/h) | 0.75 | 0.75 | 0.75 | 0.75 |
| Fuel Temperature (°F.) | 149 | 150 | 149 | 151 |
| Steam/Fuel Ratio (w/w) | 0.30 | 0.30 | 0.30 | 0.30 |
| Steam Pressure (bar) | 2.4 | 2.4 | 2.4 | 2.4 |
| COMBUSTION CHARACTERISTICS | | | | |
| CO (ppm) | 10 | 14 | 14 | 13 |
| $CO_2$ (Vol %) | 14.3 | 14.0 | 14.0 | 10.0 |
| $O_2$ (Vol %) | 3.0 | 2.9 | 2.8 | 3.1 |
| $SO_2$ (ppm) | 2100 | 1100 | 650 | 200 |
| $SO_2$ Reduction (%) | 0 | 48.0 | 69.1 | 90.5 |
| $NO_x$ (ppm) | 550 | 280 | 240 | 140 |
| $NO_x$ reduction (%) | 0 | 49.0 | 56.4 | 74.6 |
| Combustion Efficiency (%) | 99.8 | 99.9 | 99.9 | 99.9 |

(*) Analyzer out of service.

TABLE VI

| | ADDITIVE NO. 5 | | | | |
|---|---|---|---|---|---|
| | BASELINE EMULSION | EMULSION #1 | EMULSION #2 | EMULSION #3 | EMULSION #4 |
| FUEL CHARACTERISTICS | | | | | |
| Additive 5/S (Molar Ratio) | 0 | 0.15 | 0.38 | 0.50 | 0.75 |
| LHV (BTU/lb) | 12995 | 12029 | 11608 | 11203 | 10484 |
| Bitumen, wt. % | 74 | 68.5 | 66.1 | 63.8 | 59.7 |
| Water, wt. % | 26 | 31.5 | 33.9 | 36.2 | 40.3 |
| Sulfur, wt. % | 2.8 | 2.6 | 2.5 | 2.4 | 2.3 |
| OPERATING CONDITIONS | | | | | |
| Feed Rate (lb/h) | 55.1 | 59.5 | 61.7 | 63.9 | 68.3 |
| Thermal Input (MMBTU/h) | 0.75 | 0.75 | 0.75 | 0.75 | 0.75 |
| Fuel Temperature (°F.) | 149 | 150 | 149 | 151 | 149 |
| Steam/Fuel Ratio (w/w) | 0.30 | 0.30 | 0.30 | 0.30 | 0.30 |
| Steam Pressure (bar) | 2.4 | 2.4 | 2.4 | 2.4 | 2.4 |
| COMBUSTION CHARACTERISTICS | | | | | |
| Co (ppm) | 10 | 3 | 3 | 4 | 6 |
| $CO_2$ (Vol %) | 14.3 | 14.0 | 14.0 | 14.5 | 14.5 |
| $O_2$ (Vol %) | 3.0 | 3.0 | 3.0 | 3.0 | 3.0 |
| $SO_2$ (ppm) | 2100 | 1100 | 725 | 680 | 350 |
| $SO_2$ Reduction (%) | 0 | 47.6 | 65.5 | 67.6 | 83.3 |
| $NO_x$ (ppm) | 550 | 350 | 350 | 200 | (*) |
| $NO_x$ reduction (%) | 0 | 36.4 | 36.4 | 63.6 | (*) |
| Combustion Efficiency (%) | 99.8 | 99.9 | 99.9 | 99.9 | 99.9 |

(*) Analyzer out of service.

TABLE VII

| | ADDITIVE NO. 6 | | | |
|---|---|---|---|---|
| | BASELINE EMULSION | EMULSION #1 | EMULSION #2 | EMULSION #3 |
| | FUEL CHARACTERISTICS | | | |
| Additive 6/S (Molar Ratio) | 0 | 0.49 | 0.65 | 0.70 |
| LHV (BTU/lb) | 12995 | 11608 | 11203 | 10484 |
| Bitumen, wt. % | 74 | 66.1 | 63.8 | 59.7 |
| Water, wt. % | 26 | 33.9 | 36.2 | 40.3 |
| Sulfur, wt. % | 2.8 | 2.5 | 2.4 | 2.3 |
| | OPERATING CONDITIONS | | | |
| Feed Rate (lb/h) | 55.1 | 61.7 | 63.9 | 68.3 |
| Thermal Input (MMBTU/h) | 0.75 | 0.75 | 0.75 | 0.75 |
| Fuel Temperature (°F.) | 149 | 150 | 149 | 151 |
| Steam/Fuel Ratio (w/w) | 0.30 | 0.30 | 0.30 | 0.30 |
| Steam Pressure (bar) | 2.4 | 2.4 | 2.4 | 2.4 |
| | COMBUSTION CHARACTERISTICS | | | |
| CO (ppm) | 10 | 4 | 10 | 15 |
| $CO_2$ (Vol %) | 14.3 | 15.0 | 15.0 | 15.0 |
| $O_2$ (Vol %) | 3.0 | 2.7 | 3.0 | 3.0 |
| $SO_2$ (ppm) | 2100 | 650 | 350 | 250 |
| $SO_2$ Reduction (%) | 0 | 69.0 | 83.3 | 88.1 |
| $NO_x$ (ppm) | 550 | 320 | 140 | 140 |
| $NO_x$ reduction (%) | 0 | 41.8 | 74.5 | 74.5 |
| Combustion Efficiency (%) | 99.8 | 99.9 | 99.9 | 99.9 |

TABLE VIII

| | ADDITIVE NO. 7 | | | |
|---|---|---|---|---|
| | BASELINE EMULSION | EMULSION #1 | EMULSION #2 | EMULSION #3 |
| | FUEL CHARACTERISTICS | | | |
| Additive 7/S (Molar Ratio) | 0 | 0.45 | 0.60 | 0.90 |
| LHV (BTU/lb) | 12995 | 11608 | 11203 | 10484 |
| Bitumen, wt. % | 74 | 66.1 | 63.8 | 59.7 |
| Water, wt. % | 26 | 33.9 | 36.2 | 40.3 |
| Sulfur, wt. % | 2.8 | 2.5 | 2.4 | 2.3 |
| | OPERATING CONDITIONS | | | |
| Feed Rate (lb/h) | 55.1 | 61.7 | 63.9 | 68.3 |
| Thermal Input (MMBTU/h) | 0.75 | 0.75 | 0.75 | 0.75 |
| Fuel Temperature (°F.) | 149 | 150 | 149 | 151 |
| Steam/Fuel Ratio (w/w) | 0.30 | 0.30 | 0.30 | 0.30 |
| Steam Pressure (bar) | 2.4 | 2.4 | 2.4 | 2.4 |
| | COMBUSTION CHARACTERISTICS | | | |
| CO (ppm) | 10 | 10 | 6 | 8 |
| $CO_2$ (Vol %) | 14.3 | 15.0 | 15.0 | 14.5 |
| $O_2$ (Vol %) | 3.0 | 3.0 | 2.9 | 2.8 |
| $SO_2$ (ppm) | 2100 | 800 | 550 | 200 |
| $SO_2$ Reduction (%) | 0 | 61.9 | 73.8 | 90.5 |
| $NO_x$ (ppm) | 550 | 260 | 150 | 62 |
| $NO_x$ reduction (%) | 0 | 52.7 | 72.7 | 88.7 |
| Combustion Efficiency (%) | 99.8 | 99.9 | 99.9 | 99.9 |

TABLE IX

| | ADDITIVE NO. 8 | | | |
|---|---|---|---|---|
| | BASELINE EMULSION | EMULSION #1 | EMULSION #2 | EMULSION #3 |
| | FUEL CHARACTERISTICS | | | |
| Additive 8/S (Molar Ratio) | 0 | 0.56 | 0.75 | 0.93 |
| LHV (BTU/lb) | 12995 | 11608 | 11203 | 10484 |
| Bitumen, wt. % | 74 | 66.1 | 63.8 | 59.7 |
| Water, wt. % | 26 | 33.9 | 36.2 | 40.3 |
| Sulfur, wt. % | 2.8 | 2.5 | 2.4 | 2.3 |

TABLE IX-continued

| | ADDITIVE NO. 8 | | | |
|---|---|---|---|---|
| | BASELINE EMULSION | EMULSION #1 | EMULSION #2 | EMULSION #3 |
| OPERATING CONDITIONS | | | | |
| Feed Rate (lb/h) | 55.1 | 61.7 | 63.9 | 68.3 |
| Thermal Input (MMBTU/h) | 0.75 | 0.75 | 0.75 | 0.75 |
| Fuel Temperature (°F.) | 149 | 150 | 149 | 151 |
| Steam/Fuel Ratio (w/w) | 0.30 | 0.30 | 0.30 | 0.30 |
| Steam Pressure (bar) | 2.4 | 2.4 | 2.4 | 2.4 |
| COMBUSTION CHARACTERISTICS | | | | |
| CO (ppm) | 10 | 30 | 7 | 10 |
| $CO_2$ (Vol %) | 14.3 | 14.0 | 14.0 | 14.0 |
| $O_2$ (Vol %) | 3.0 | 3.0 | 2.9 | 3.0 |
| $SO_2$ (ppm) | 2100 | 550 | 180 | 75 |
| $SO_2$ Reduction (%) | 0 | 73.8 | 91.4 | 96.4 |
| $NO_x$ (ppm) | 550 | 230 | 150 | 100 |
| $NO_x$ reduction (%) | 0 | 58.2 | 67.3 | 81.8 |
| Combustion Efficiency (%) | 99.8 | 99.9 | 99.9 | 99.9 |

TABLE X

| | ADDITIVE NO. 9 | | |
|---|---|---|---|
| | BASELINE EMULSION | EMULSION #1 | EMULSION #2 |
| FUEL CHARACTERISTICS | | | |
| Additive 9/S (Molar Ratio) | 0 | 0.011 | 0.097 |
| LHV (BTU/lb) | 13337 | 13277 | 12900 |
| Bitumn, wt. % | 78 | 78 | 70 |
| Water, wt. % | 22 | 22 | 30 |
| Sulfur, wt. % | 3.0 | 3.0 | 2.7 |
| OPERATING CONDITIONS | | | |
| Feed Rate (lb/h) | 60.0 | 60.0 | 66.7 |
| Thermal Input (MMBTU/h) | 0.82 | 0.82 | 0.82 |
| Fuel Temperature (°F.) | 154 | 154 | 154 |
| Steam/Fuel Ratio (w/w) | 0.30 | 0.30 | 0.30 |
| Steam Pressure (bar) | 2.4 | 2.4 | 2.4 |
| COMBUSTION CHARACTERISTICS | | | |
| CO (ppm) | 36 | 27 | 20 |
| $CO_2$ (Vol %) | 13.0 | 12.9 | 12.9 |
| $O_2$ (Vol %) | 3.0 | 2.9 | 3.0 |
| $SO_2$ (ppm) | 2347 | 1775 | 165 |
| $SO_2$ Reduction (%) | 0 | 24.4 | 93.1 |
| $NO_x$ (ppm) | 450 | 498 | 434 |
| $NO_x$ reduction (%) | 0 | (9.7) | 3.5 |
| Combustion Efficiency (%) | 99.8 | 99.8 | 99.9 |

TABLE XI

| | ADDITIVE NO. 10 | | |
|---|---|---|---|
| | BASELINE EMULSION | EMULSION #1 | EMULSION #2 |
| FUEL CHARACTERISTICS | | | |
| Additive 10/S (Molar Ratio) | 0 | 0.30 | 0.78 |
| LHV (BTU/lb) | 13086 | 12742 | 10845 |
| Bitumen, wt. % | 76 | 74 | 63 |
| Water, wt. % | 24 | 26 | 37 |
| Sulfur, wt. % | 2.9 | 2.8 | 2.4 |
| OPERATING CONDITIONS | | | |
| Feed Rate (lb/h) | 55.1 | 56.2 | 66.0 |
| Thermal Input (MMBTU/h) | 0.72 | 0.72 | 0.72 |
| Fuel Temperature (°F.) | 149 | 149 | 149 |
| Steam/Fuel Ratio (w/w) | 0.30 | 0.30 | 0.30 |
| Steam Pressure (bar) | 2.4 | 2.4 | 2.4 |
| COMBUSTION CHARACTERISTICS | | | |
| $CO_2$ (Vol %) | 13.5 | 14.0 | 13.2 |
| $O_2$ (Vol %) | 3.0 | 2.9 | 3.0 |
| $SO_2$ (ppm) | 2357 | 1250 | 167 |
| $SO_2$ Reduction (%) | 0 | 47.0 | 92.9 |
| $NO_x$ (ppm) | 500 | 430 | 218 |
| $NO_x$ reduction (%) | 0 | 14.0 | 56.4 |
| Combustion Efficiency (%) | 99.8 | 99.9 | 99.8 |

Figure 1:
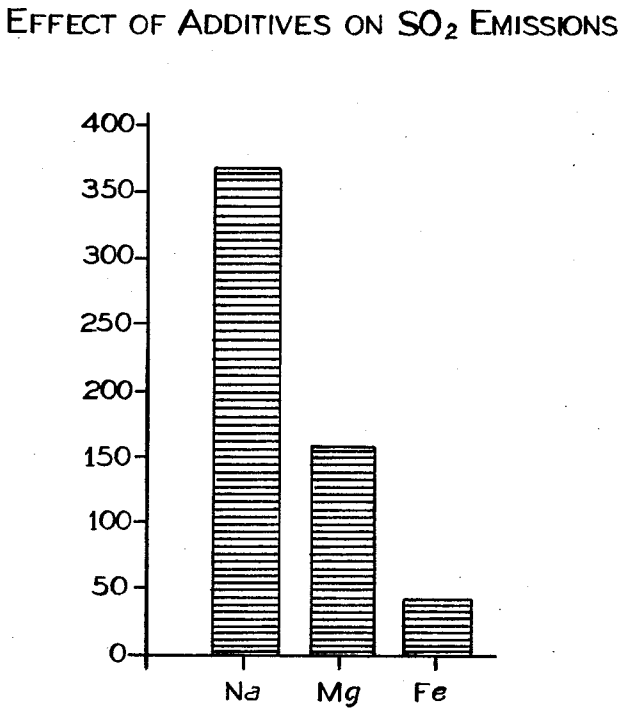
FIG. 1 is a bar graph showing the effect of additives on the reduction of $SO_2$ emissions.

As can be seen from the foregoing tables, $Fe^{++}$ additions to the additive has a marked effect on reducing nitrogen oxide emissions upon combustion of the fuel. The comparative effect of $Fe^{++}$ on nitrogen oxide additions compared to the effect obtained from $Na^{+}$ and element X (in this case magnesium) is set forth in FIG. 2. Likewise, as can be seen from the foregoing tables II–XI, $Na^{+}$ has a marked effect on reducing sulfur oxide emissions when compared to iorn and the element X addition. See FIG. 1.

In addition to the foregoing, it is seen from the foregoing combustion data that the molar ratio of additive to sulfur in the hydrocarbon fuel has an effect on the reduction of $SO_2$ and nitrogen oxide with reductions of greater than 80% in $SO_2$ being obtained at molar ratios of additive to sulfur of greater than 0.500 and preferably greater than 0.750.

In addition to the foregoing, the combustion ash characterisitics for Emulsion 5 of Table II and Emulsion 2 of Table IX were analyzed. The compositions are set forth below in Table XII.

TABLE XII

| ASH CHARACTERISTICS | | | |
|---|---|---|---|
| Additive | Compound | Melting Point (°F.) | Observations |
| TABLE X | $3Na_2O.V_2O_5$ | 1562 | POTENTIALLY |
| ADDITIVE | $2Na_2O.V_2O_5$ | 1184 | CORROSIVE |
| 9 | $Na_2O.V_2O_5$ | 1166 | |

TABLE XII-continued

| ASH CHARACTERISTICS | | | |
|---|---|---|---|
| Additive | Compound | Melting Point (°F.) | Observations |
| | $Na_2SO_4$ | 1616 | |
| | $Na_2O.V_2O_4.5V_2O_5$ | 1157 | |
| TABLE II | $MgSO_4$ | 2055 | NON- |
| ADDITIVE | $3MgO.V_2O_5$ | 2174 | CORROSIVE |
| 1 | $NiSO_4$ | 1544 | |
| | MgO | 2642 | |
| | $Na_2SO_4$ | 1616 | |

The ash composition employing additive 9 (a high sodium additive composition) indicates that the ash is potentially corrosive and therefore undesirable. Accordingly, the ideal additive composition in order to minimize sulfur oxide and nitrogen oxide emissions and reduce the potential for corrosion comprises $Na^+$ in an amount of about 5 to 40 wt.%, $Fe^{++}$ in an amount of between 0.4 to 2.0 wt.% with the balance essentially element X.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for controlling sulfur oxide and nitrogen oxide formation and emissions when burning by forming a combustible fuel prepared from a bitumen or residual fuel oil hydrocarbon containing sulfur and nitrogen comprising:

(a) mixing a sulfur and nitrogen containing hydrocarbon with a water soluble additive wherein said water soluble additive consist essentially of $Na^+$, $Fe^{++}$ and an element X selected from the group consisting of $Mg^{++}$, $Ba^{++}$, $Ca^{++}$, $Li^+$, $K^+$ and mixtures thereof wherein $Na^+$ is present in an amount of less than or equal to 40 wt.%, $Fe^{++}$ is present in an amount of greater than or equal to 0.4 wt.%, balance essentially X wherein the ratio of $Na^+$ to $Fe^{++}$ is about between 7.5:1.0 to 100:1.0 and the molar ratio of additive to sulfur in said hydrocarbon is greater than about 0.500.

2. A process according to claim 1 wherein $Na^+$ is present in an amount of between 15 to 40 wt.%, $Fe^{++}$ is present in an amount of 0.4 to 2.0 wt.%, balance essentially X.

3. A process according to claim 1 wherein the molar ratio of additive to sulfur is greater than 0.750.

4. A process according to claim 1 wherein said hydrocarbon is a hydrocarbon in water emulsion formed by admixing a mixture of a sulfur containing hydrocarbon in water with an emulsifier wherein said emulsion has a water content of about between 5 to 40 volume percent.

5. A bitumen or residual fuel oil hydrocarbon combustible fuel comprising a sulfur and nitrogen containing hydrocarbon and a water soluble sulfur and nitrogen capturing additive wherein said water soluble additive consists essentially of $Na^+$, $Fe^{++}$ and an element X selected from the group consisting of $Mg^{++}$, $Ba^{++}$, $Ca^{++}$, $Li^+$, $K^+$ and mixtures thereof wherein $Na^+$ is present in an amount of less than or equal to 40 wt.%, $Fe^{++}$ is present in an amount of greater than or equal to 0.4 wt.%, balance essentially X wherein the ratio of $Na^+$ to $Fe^{++}$ is about between 7.5:1.0 to 100:1.0 and the molar ratio of additive to sulfur is greater than 0.500.

6. A hydrocarbon combustible fuel according to claim 5 wherein $Na^+$ is present in an amount of between 15 to 40 wt.%, $Fe^{++}$ is present in an amount of 0.4 to 2.0 wt.%, balance essentially X.

7. A hydrocarbon combustible fuel according to claim 5 wherein the molar ratio of additive to sulfur is greater than 0.750.

* * * * *

UNITED STATES PATENT AND TRADEMARK OFFICE

CERTIFICATE OF CORRECTION

PATENT NO. : 4,824,439

DATED : April 25, 1989

INVENTOR(S) : Domingo Rodriguez Polanco et al.

It is certified that error appears in the above-identified patent and that said Letters Patent is hereby corrected as shown below:

In Column 7, Table VI, after the Title "COMBUSTION CHARACTERISTICS", line 1, delete "Co (ppm) and insert --CO (ppm).

In Column 12, Table XI, after the Title "COMBUSTION CHARACTERISTICS", before "$CO_2$ (Vol %) 13.5 14.0 13.2" insert --CO (ppm) 21 30 10--.

*In Column 12, line 48, delete "iorn" and insert --ion--.

In Column 12, line 68, after "9 $Na_2O.V_2O_5$ 116" insert the following:

--$Na_2SO_4$ 1616--; and

--$Na_2O.V_2O_4.5V_2O_5$ 1157--.

Signed and Sealed this

Twenty-second Day of February, 1994

*Attest:*

Bruce Lehman

BRUCE LEHMAN

*Attesting Officer*

*Commissioner of Patents and Trademarks*